US011885604B1

(12) United States Patent
Belanger

(10) Patent No.: US 11,885,604 B1
(45) Date of Patent: Jan. 30, 2024

(54) FIREARM CARTRIDGE

(71) Applicant: Scott Belanger, New Boston, NH (US)

(72) Inventor: Scott Belanger, New Boston, NH (US)

( * ) Notice: Subject to any disclaimer, the term of this patent is extended or adjusted under 35 U.S.C. 154(b) by 0 days.

(21) Appl. No.: 17/891,265

(22) Filed: Aug. 19, 2022

(51) Int. Cl.
*F42C 19/08* (2006.01)

(52) U.S. Cl.
CPC ..... *F42C 19/083* (2013.01)

(58) Field of Classification Search
CPC ..... F42C 15/42; F42C 19/083; F42C 19/0834
See application file for complete search history.

(56) References Cited

U.S. PATENT DOCUMENTS

| | | | | |
|---|---|---|---|---|
| 3,400,393 | A | 9/1968 | Ash | |
| 4,488,370 | A | 12/1984 | Lemelson | |
| 6,223,461 | B1 | 5/2001 | Mardirossian | |
| 6,283,034 | B1 * | 9/2001 | Miles, Jr. | F42B 5/08 42/70.11 |
| 6,301,815 | B1 | 10/2001 | Sliwa | |
| 6,760,992 | B2 | 7/2004 | Brosow | |
| 6,823,621 | B2 | 11/2004 | Gotfried | |
| 6,975,204 | B1 | 12/2005 | Silver | |
| 8,904,689 | B2 | 12/2014 | Kountotsis | |
| 9,903,694 | B2 * | 2/2018 | Palo | F42C 15/00 |
| 10,197,350 | B2 | 2/2019 | Kauffman | |
| 2006/0244612 | A1 | 11/2006 | Pridmore, Jr. | |
| 2014/0083318 | A1 | 3/2014 | Templ | |
| 2015/0007741 | A1 | 1/2015 | Nath | |
| 2015/0233660 | A1 * | 8/2015 | Barton | F42B 5/02 89/27.12 |
| 2016/0025438 | A1 | 1/2016 | Alderman | |

FOREIGN PATENT DOCUMENTS

| | | | |
|---|---|---|---|
| IL | 144994 | A1 | 12/2007 |
| WO | 2014142920 | A1 | 9/2014 |

OTHER PUBLICATIONS

Aniruddh Vashisth, Shegufta T. Upama, Muhammad Anas, Ju-Hyun Oh, Nutan Patil and Micah J. Green, Radio frequency heating and material processing using carbon susceptors, https://pubs.rsc.org/en/content/articlehtml/2021/na/d1na00217a, Jul. 30, 2021.

Le-Giang Tran, Hyouk-Kyu Cha & Woo-Tae Park, RF power harvesting: a review on designing methodologies and applications, https://mnsl-journal.springeropen.com/articles/10.1186/s40486-017-0051-0, Feb. 28, 2017.

Tiny chip that powers itself from radio waves, https://www.bbc.com/news/technology-35038430, Dec. 8, 2015.

(Continued)

*Primary Examiner* — Reginald S Tillman, Jr.
(74) *Attorney, Agent, or Firm* — Lambert Shortell & Connaughton; David J. Connaughton, Jr.; Justin P. Tinger

(57) ABSTRACT

A firearms cartridge is provided which is equipped with a signal receiver. The signal receiver is operable to disable the firearm when it received a predetermined signal, such as a signal on the electromagnetic spectrum, acoustic signal, and the like. When the signal is not present, the firearm cartridge works like a traditional unrestricted firearm cartridge allowing a firing of the weapon.

13 Claims, 8 Drawing Sheets

(56) References Cited

OTHER PUBLICATIONS

Jelor Gallego, Tiny Supercapacitors Built Directly on a Chip, Making More Powerful Microchips, https://futurism.com/tiny-supercapacitors-embedded-chip-allow-efficient-low-energy-chips, Feb. 28, 2016.

Andrew Stapleton, Ultrathin Device Generates Power From Even The Most Subtle Human Movement, https://webcache.googleusercontent.com/search?q=cache:hGVbHHqPC3wJ:https://www.sciencealert.com/ultrathin-device-generates-power-from-human-movement+&cd=18&hl=en&ct=clnk&gl=us, Jul. 28, 2017.

Peter Dockrill, This Battery-Free Cellphone Works by Harvesting Power From Ambient Radio Signals, https://www.sciencealert.com/this-battery-free-cellphone-works-by-harvesting-power-from-ambient-radio-signals, Jul. 6, 2017.

E&T Editorial Staff, Scientists have developed small, flexible generators that enable smart devices to charge themselves using energy harnessed from the movements of their user, https://eandt.theiet.org/content/articles/2020/06/smart-devices-could-convert-motion-into-electricity/, Jun. 19, 2020.

* cited by examiner

FIREARM CARTRIDGE

BACKGROUND

Technical Field

The present disclosure relates generally to firearm cartridges. More particularly the present disclosure relates to a cartridge which is fireable in a first mode, but prevented from firing in a second mode when exposed to an electromagnetic, acoustic, or similar signal.

Description of Related Art

Firearms are ubiquitous in the United States of America. Indeed, the United States has enshrined the right of its citizens to own firearms in its founding documents. Within the last few decades however, there has been a shocking rise in so-called "mass shooting" events wherein a shooter opens fire in a crowded public space, most notably in schools. This has predictably sewn fear and consternation among the public, but the current laws provide limitations on the restrictions that can be placed on firearm ownership.

Some solutions such as metal detectors and increased police presence have been implemented to catch and/or deter would-be shooters. However, these solutions are costly, lower morale and are constant reminders of the danger of being in public spaces to the vast majority of attendees.

Therefore, what is needed is a firearm cartridge which can be disabled remotely, preventing firing of a weapon in a public setting.

SUMMARY

The subject matter of this application may involve, in some cases, interrelated products, alternative solutions to a particular problem, and/or a plurality of different uses of a single system or article.

In one aspect, a firing primer for use in a firearm cartridge is provided. The primer is formed having a body and a rear wall, and a quantity of priming compound within the body. A signal receiver is also positioned within the body, typically, though not always, positioned adjacent to the rear wall of the primer. The signal receiver is operable to allow ignition of the quantity of priming compound when not in the presence of a predetermined signal, and operable to prevent ignition of the quantity of priming compound when in the presence of the predetermined signal. In this way, the ability of a firearms cartridge to fire a bullet may be controlled by the presence of the signal which can deactivate the primer and in turn the ability of the cartridge to fire the bullet. The signal thus creates a zone in which a firearm cannot be fired.

In another aspect, a firearm cartridge is provided. The cartridge has a cartridge case, a quantity of gunpowder within the cartridge case, a bullet at a proximal end of the cartridge case, and a primer. The primer is formed having a body and a rear wall, and a quantity of priming compound within the body. A signal receiver is also positioned within either the primer cap or within the cartridge case, typically, though not always, positioned adjacent to the rear wall of the primer. The signal receiver is operable to allow ignition of both the quantity of gunpowder and quantity of priming compound when not in the presence of a predetermined signal, and operable to prevent ignition of at least one of the quantity of gunpowder and the quantity of priming compound when in the presence of the predetermined signal.

In yet another aspect, a facility having restricted firearm usage is provided. The facility defines a facility area or "zone." The facility has one or more signal transmitters which are configured to emit a signal covering at least part of the facility area and in many embodiments, the signal transmitter(s) are configured to emit a signal covering the entire area or zone of the facility. The signal transmitters are configured to emit a signal which is operable to deactivate a firearm cartridge of this disclosure, preventing its firing. Exemplary firearm cartridges which can be deactivated are disclosed in the above aspects and elsewhere throughout this disclosure.

DETAILED DESCRIPTION

Figure 1:
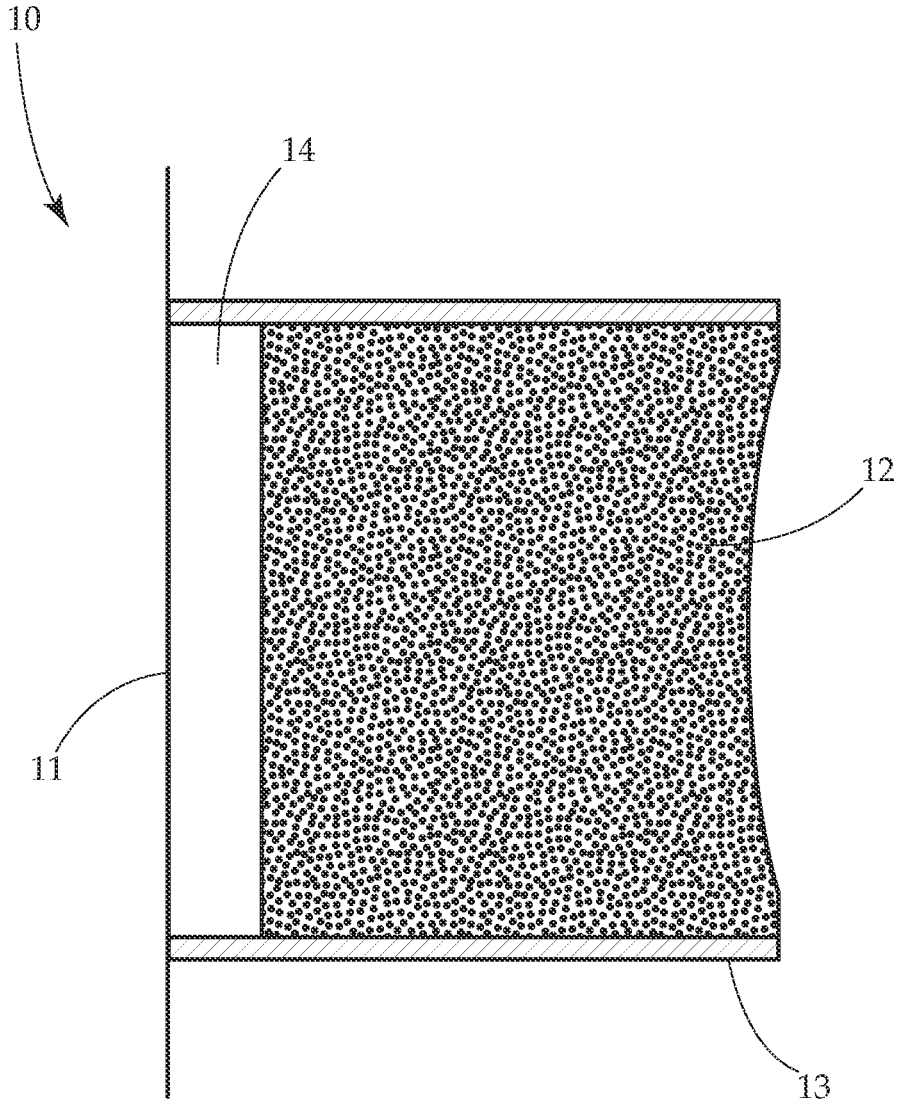
FIG. 1 provides a side view of an embodiment of the present disclosure.

The detailed description set forth below in connection with the appended drawings is intended as a description of presently preferred embodiments of the invention and does not represent the only forms in which the present disclosure may be constructed and/or utilized. The description sets forth the functions and the sequence of steps for constructing and operating the invention in connection with the illustrated embodiments.

While there are many laws on record in the United States protecting the ownership of firearms, including the Second Amendment to the US Constitution, the regulation of ammunition is more permissive and not protected by foundational legal documents. Therefore, the present invention is directed to a firearms cartridge which can be deactivated remotely under certain conditions and in certain locations, namely public settings where innocent people could be hurt.

Generally, the present disclosure concerns a firearms cartridge which is controllably fired such that, when a certain signal is present, for example in a school, the firearms cartridge cannot be fired, but when the signal is not present, such as when hunting in the woods, the firearms cartridge can be fired in the same way that a traditional firearms cartridge may operate. In certain embodiments, firing control components and structure may be incorporated into the primer cap of the cartridge. In other embodiments, firing control and structure may be within the firearm cartridge case. In still other embodiments, firing control and structure may be incorporated into both the primer cap and the cartridge case.

By creating an ammunition which allows deactivation of firing, the present disclosure creates a paradigm where "safe" locations can be created to stop a would-be mass shooter or otherwise control the unauthorized firing of a firearm. This can be deployed at fixed facilities such as schools, malls, theaters, stadiums and other places where large groups gather. Further, the system can be deployed at other large gatherings such as outdoor parades, rallies, political and social events, and the like but bringing a portable signal transmitter or transmitters and emitting the particular signal which will disable the ammunition by preventing firing.

In many embodiments, control of the firing of the firearms cartridge is implemented on the primer, which, when firing the bullet, initiates the first in a series of actions that results in firing. The primer referred to herein as the portion of the firearms cartridge which is struck or otherwise actuated by the firearm to eventually ignite the propellant which fires the bullet. Typically, the primer uses an impact-sensitive material called priming compound which ignites when struck by a firing pin. In other embodiments, a piezoelectric primer cap may be used, or any other structure which can, when struck, work to ignite nearby propellant in the firearms cartridge. Primer caps may be a centerfire cap, rimfire cap, or any other primer used in a firearms cartridge to initiate the firing of a bullet.

The signal referred to in this disclosure may be any signal which can be transmitted over a relatively large area reliably and without disruption of people within the area. This signal is typically along the electromagnetic spectrum and more particularly is a radio-frequency signal. The predetermined signal may be a particular wavelength, amplitude and/or pattern, or ranges thereof, to cause the disabling of the primer/firearm cartridge. In some cases, an acoustic signal may be used, such as a sound frequency and/or pattern which is well above or below human hearing range.

The signal receiver within the firearm cartridge and/or within the primer cap may be any device or material which can be affected by the selected signal for disabling the ammunition. In some embodiments, the signal receiver may be an antenna, while in other embodiments the signal receiver may be a material or a part of the material having a property which responds to or is affected by the presence of the signal such as an electro-active material, or radio-frequency active material.

In some embodiments, energy, such as electrical energy, is required to cause the physical change within the primer cap or cartridge to prevent firing. This energy may be stored or gathered. For example, in a stored energy embodiment, a small battery or supercapacitor may store energy to cause the change when in the presence of the signal. In other embodiments, a small battery, capacitor or supercapacitor may be charged by the movement of the cartridge, storing the kinetic energy from the movement.

In one embodiment, the signal receiver is in communication with a polymer, and the polymer is operable to soften or change shape under application of a current through the polymer. The signal receiver may be programmed to apply a current to the polymer, causing the polymer to soften or change shape when in the presence of the predetermined signal, such that an impact on the rear wall of the primer body does not transfer a force to the priming compound sufficient to ignite the priming compound.

In still further embodiments, the components or materials may receive the energy required for operation from the signal itself and/or from other signals it is exposed to. For example, a microchip which can be powered by radio-frequency and use this energy to operate the activation/deactivation. Or, a material having radio-frequency activated properties such as a polymer containing carbon nanomaterials which can be heated in the presence of the selected radio-frequency signal, among other options. The carbon nanomaterials, when mixed into, for example, a heat-sensitive polymer can cause the polymer to soften or deform enough to be operable to prevent force transfer from a firing pin and in turn, prevent firing of the bullet. Other radio-frequency active materials may also be used.

"Tuning" of the mechanism to allow or limit firing of the ammunition may be achieved based on the selected signal. For example if a particular frequency is selected, the signal receiver, if an antenna, may be configured to identify the particular frequency. If the signal receiver is a material which may have a property change under the signal exposure, the material may be configured with the proper component selection and properties to operate as desired. In one embodiment, this may involve optimizing a quantity of, for example, carbon nanomaterials which are activated by the selected frequency, combined with optimizing surrounding polymer or other material selection to be hard at ambient operating temperatures, but soften or deform, contract, etc when the carbon nanomaterials are "activated" by the signal.

In further embodiments, a similar sound-frequency active material may be used to soften, deform, contract, or the like to prevent ignition of the priming compound by the firearm's firing pin. Such a material may itself be affected by a certain sound frequency, amplitude, pattern or the like. Or, in other embodiments, upon receipt of a sound frequency by the signal receiver, a change in the material may be affected by, for example, a current passing through the material. This current, as noted above, may come from an energy storage device such as a battery or capacitor/supercapacitor, or may be generated by energy gathered from the signal itself, ambient radio waves other than the signal, movement, or the like.

In some embodiments, the primer cap has a spacing, as seen in the figures, in which a material crosses the spacing to allow force from a firing pin to transfer to the priming compound, igniting the priming compound and in turn the propellant (gunpowder) within the cartridge, firing the bullet. This material, often a polymer, is operable to be softened or deformed when in the presence of the radio frequency so that, when struck by the firing pin, the force transferred to the priming compound is minimized or eliminated. For example, the material may soften and then when struck by the firing pin, the material absorbs the energy and does not transfer it to the priming compound. Similarly, in other embodiments, the material may deform, such as by contracting away from the priming compound to create a spacing. When struck by the firing pin, the force does not transfer across the spacing, thus preventing ignition of the priming compound. In still other embodiments, the signal receiver is in communication with an inner wall of the primer cap. The signal receiver is operable to cause a movement of the inner wall which spaces the inner wall, adjacent to the primer material, away from the rear wall. As such, when the rear wall is struck by the firing pin of the firearm, it does not transfer sufficient force to the priming compound to ignite it.

Signal powered components, such as microchips and devices to generate an electrical current across a material or to cause a movement of a component may be used. In one embodiment, signal powered components utilize an antenna to gather the signal energy and a rectifier to convert the alternating current of the electromagnetic or acoustical signal and cover it to direct current. This direct current can then be used to, for example, soften a material, activate a switch, space away one surface from another, and the like to deactivate the primer cap and/or firearm cartridge. Other embodiments of signal powered components involve the antenna receiving the energy from the signal and/or ambient other signals such as nearby cellular or Wi-Fi and other radio signals, and storing it an energy storage element such as a battery, capacitor or supercapacitor until sufficient energy is available to use.

In some embodiments, a phase change material may be used to allow or prevent force transfer from the firing pin on the rear wall of the primer to the priming material and/or propellant. The phase change material may be a solid in an environment where the predetermined signal is not present, and liquefy when the signal is present. Phase change may be affected by any means without straying from the scope of the invention. In one embodiment, an electrical current may pass through the material to cause the phase change. In another embodiment, the signal itself may interact with the material to case the phase change.

In other embodiments, energy for the operation of the deactivation of the firearm may be gathered by the motion of the firearm cartridge as it is carried around. Materials such as graphene and black phosphorus, among others, can be used to extract energy from movement which can then be stored and used. Similar tools called triboelectric nanogenerators may also be used to gather the required energy for operation of the deactivating components.

In another embodiment, the cartridge may be operable to break the chain reaction of firing the bullet after the primer cap and before the propellant (gunpowder) is ignited. In this embodiment, a controllable separation may be positioned between primer cap and propellant. This may allow ignited priming compound to be directed away and vented from the cartridge rather than igniting the propellant. In one embodiment, an actuator may space the primer cap close to the propellant in an active mode, and draw it away and block the propellant when in a deactivated mode as initiated by the presence of the predetermined signal. However, this suffers from at least two drawbacks compared to a primer-controlled firearm cartridge. First, once the priming compound is ignited, if the bullet has not been fired, the entire cartridge is unusable and must be discarded. This is sometimes, though not always, the case with a controlled primer cap. Second, from a practical perspective it is more complex and difficult to prevent ignition of the propellant once the reactive priming compound has been ignited. It is generally more simple and easier to implement to control activation at the primer cap stage to prevent ignition of the priming compound, rather than after ignition of the priming compound. Still, embodiments of firearm cartridges which break the chain reaction of firing the bullet after the primer cap and before the propellant (gunpowder) is ignited remain contemplated in this disclosure.

In yet another embodiment, a switch may be used to allow firing when the predetermined signal is not present, and prevent firing when the predetermined signal is present. Switch actuation may be achieved via electrical control, by a movement of a signal-sensitive material, and in any other way. The switch is in communication with the signal receiver. In one embodiment, the switch is operable to bridge a rear wall of the body of the primer cap to the priming compound when not in the presence of the predetermined signal, and wherein the switch opens to create a physical separation between the rear wall of the body and the priming compound.

Turning now to FIG. 1, an embodiment of a primer cap of the present disclosure is shown. In this embodiment, restricted operation of the firearm cartridge is controlled by restricted operation of the primer cap. If the primer cap is prevented from activating, the bullet cannot fire. The primer cap 10 in this embodiment has a body 13 and rear wall 11. A quantity of priming compound 12 is contained within the body 13. A rear wall 11 of the primer cap 10 is operable to be struck by a firing pin which in turn ignites the priming compound 12. In this embodiment, the quantity of priming compound 12 is spaced apart from the rear wall 11 by a cavity 14. In various embodiments discussed and/or shown throughout, this cavity 14 is usable to allow a component to prevent the firing pin from applying a sufficient force to the priming compound 12 to ignite it when in the presence of the predetermined signal. Without this signal however, component(s) within the cavity 14 allow traditional firing of the cartridge by a firearm including ignition of the firing compound 12 by impact from the firing pin.

Figure 2:
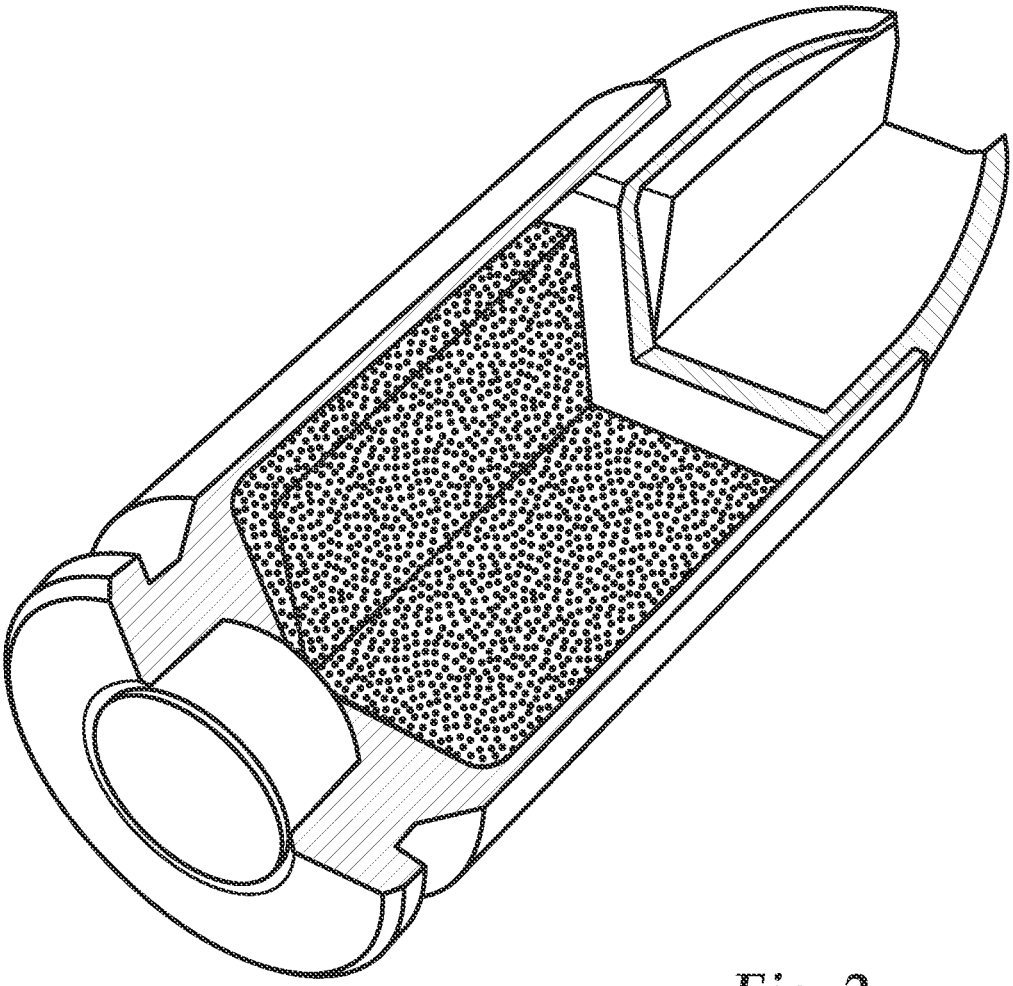
Fig. 2 Prior Art
FIG. 2 provides a perspective view of a prior art firearms cartridge.

FIG. 2 shows a cutaway view of a firearms cartridge of the prior art. The cartridge has a case which surrounds and holds together the components until fired. At a distal end is the bullet which is adjacent to a quantity of propellant-namely gunpowder. A primer cap is positioned at the proximal end of the cartridge. As noted, the primer cap is operable to, upon impact from a firing pin, ignite the propellant and in turn fire the bullet. In most embodiments, the present disclosure allows controlled firing of the firearm based on a control of actuation of the primer. However, in other embodiments, a break between the primer and propellant (gunpowder) may be possible as well without straying from the scope of this disclosure.

Figure 3:
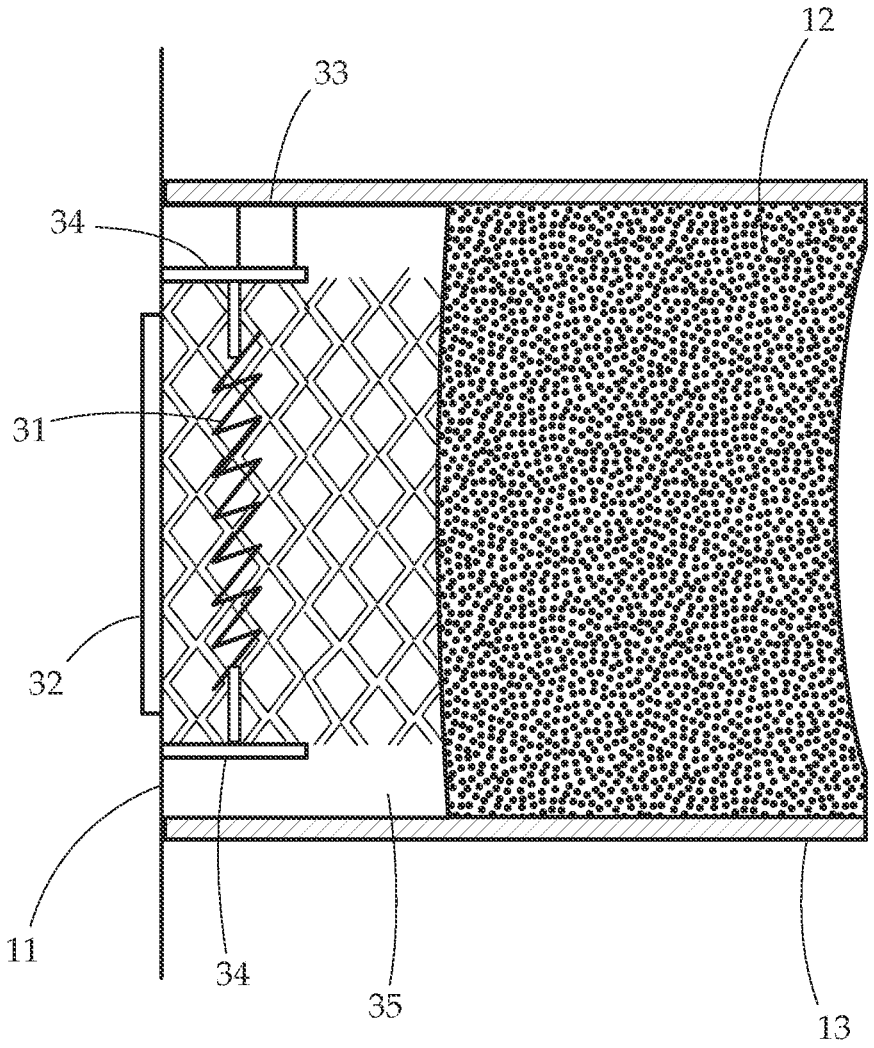
FIG. 3 provides a side cutaway view of another embodiment of the present disclosure.
Figure 4A:
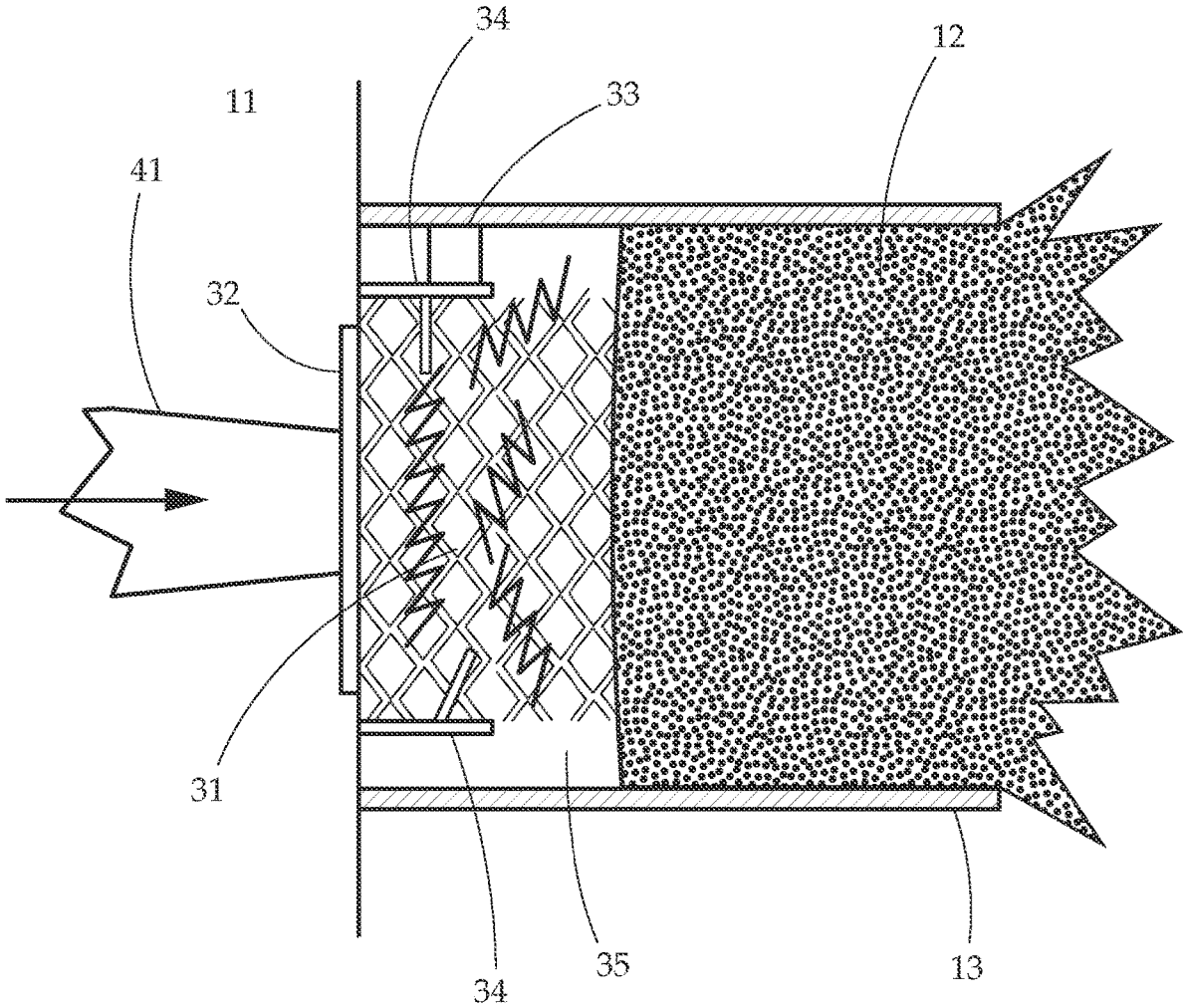
FIG. 4A provides a side cutaway view of an embodiment of the present disclosure.
Figure 4B:
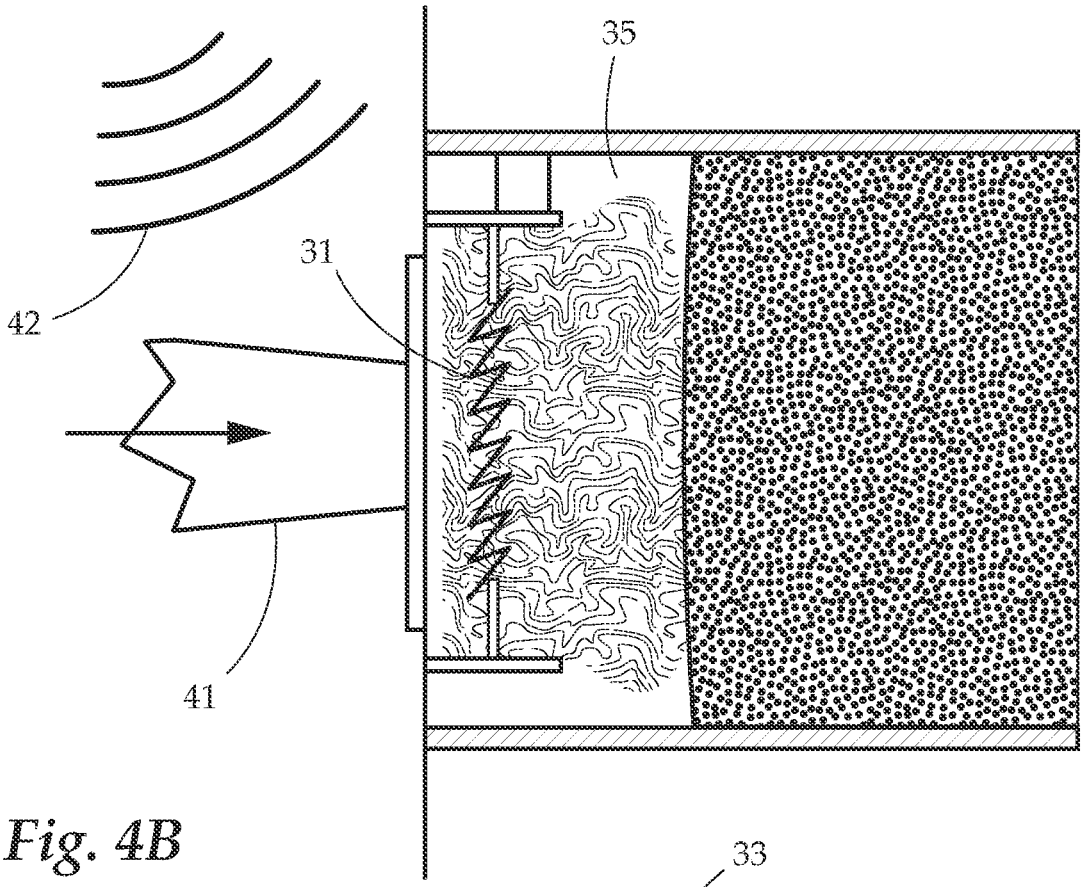
FIG. 4B provides a side cutaway view of an embodiment of the present disclosure.

FIGS. 3 and 4A-C provide views of an embodiment of a primer cap which is operable to prevent firing of a firearm cartridge in the presence of the predetermined signal, and allow firing of the cartridge when not in the presence of the signal. A primer cap has a body 13 and rear wall 11. Rear wall 11 has a striking surface 32 in this embodiment, though in other embodiments the rear wall 11 itself may be the striking surface which is impacted by the firing pin of the firearm (not shown). Within the cavity 35 between the rear wall and the priming compound 12 is a control system which restricts ignition of the priming compound. The control system includes a signal receiver 33 which in this view is incorporated on a microchip. The receiver 33 is in communication with electrodes 34. A polymer 31 which is positioned between the electrodes 34 extends between the rear wall 11 and the priming compound 12. The polymer 31 is selected to be an electroactive polymer which is rigid at rest but softens, deforms, and or contracts upon exposure to an electric current. As seen in FIGS. 3 and 4A, the polymer 31 is in a rigid state and will transfer force from the firing pin 41 to the priming compound 12 to ignite the priming compound 12 and in turn fire the bullet from the cartridge. In FIG. 3B, a signal 42 is present and received by the receiver 33 and microchip. This causes the electrodes 34 to pass a current through the polymer 31 which, depending on type of electroactive polymer being used, causes the polymer 31 to contract away from the priming compound 12 or to soften or deform such that force is not transferred from firing pin 41 to priming compound.

Figure 4C:
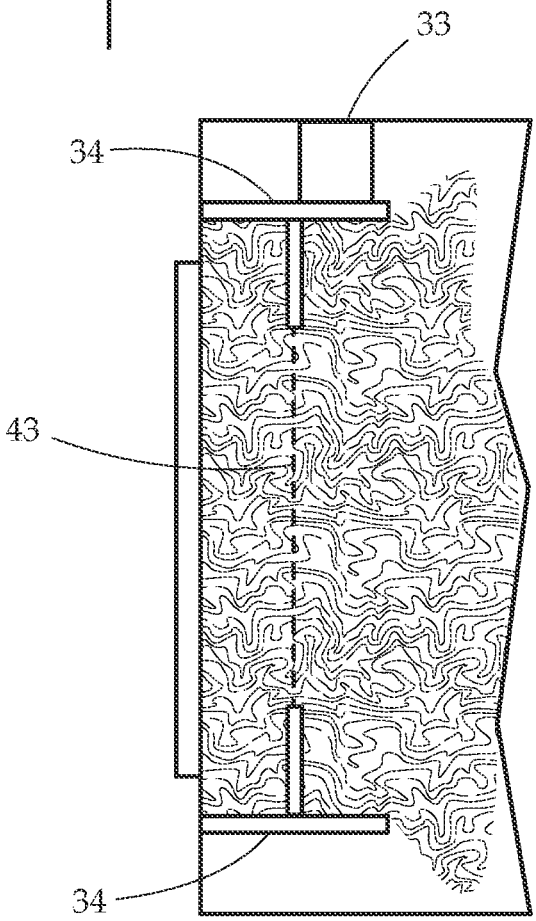
FIG. 4C provides a detail view of the embodiment of FIG. 4B of the present disclosure.

FIG. 4C provides a similar embodiment using a radio-frequency activated polymer 43 which softens and/or deforms in the presence of a radio frequency. Such an embodiment uses the polymer itself as the signal receiver. As noted above, in one embodiment, the polymer comprises carbon nanomaterials which are heated in response to electric fields in the radio frequency range. These carbon nanomaterials in turn can heat the polymer 43, which causes the polymer 43 to soften and/or deform sufficiently to prevent force transfer from the firing pin 41 to the priming compound 12. Of course, other radio-frequency active polymers or materials may be used without straying from the scope of this disclosure. In the embodiment shown, the polymer 43 is held between two walls 44 which hold the polymer 43 in place. In a particular embodiment, the radio-frequency activated polymer is operable to soften or change shape when in the presence of the predetermined signal, such that an impact on the rear wall of the primer body does not transfer a force to the priming compound within the primer body sufficient to ignite the priming compound.

Figure 5A:
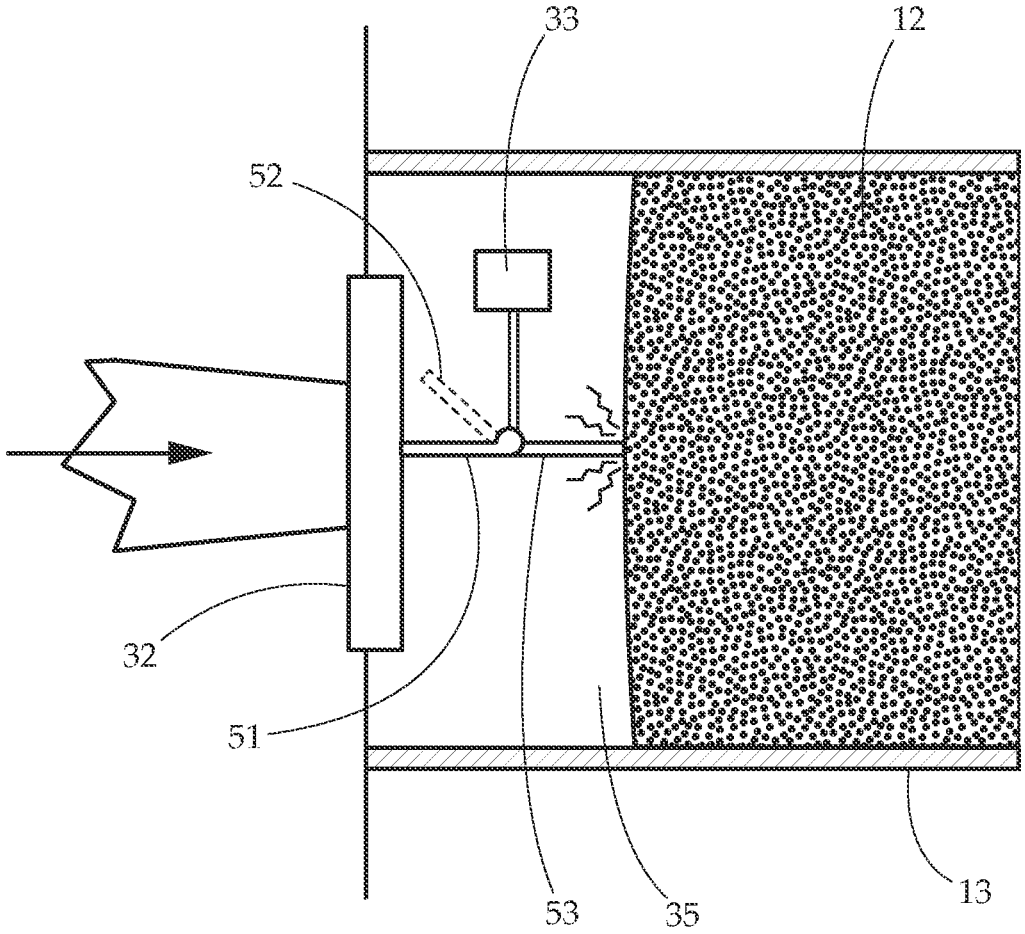
FIG. 5A provides a side cutaway view of yet another embodiment of the present disclosure.
Figure 5B:
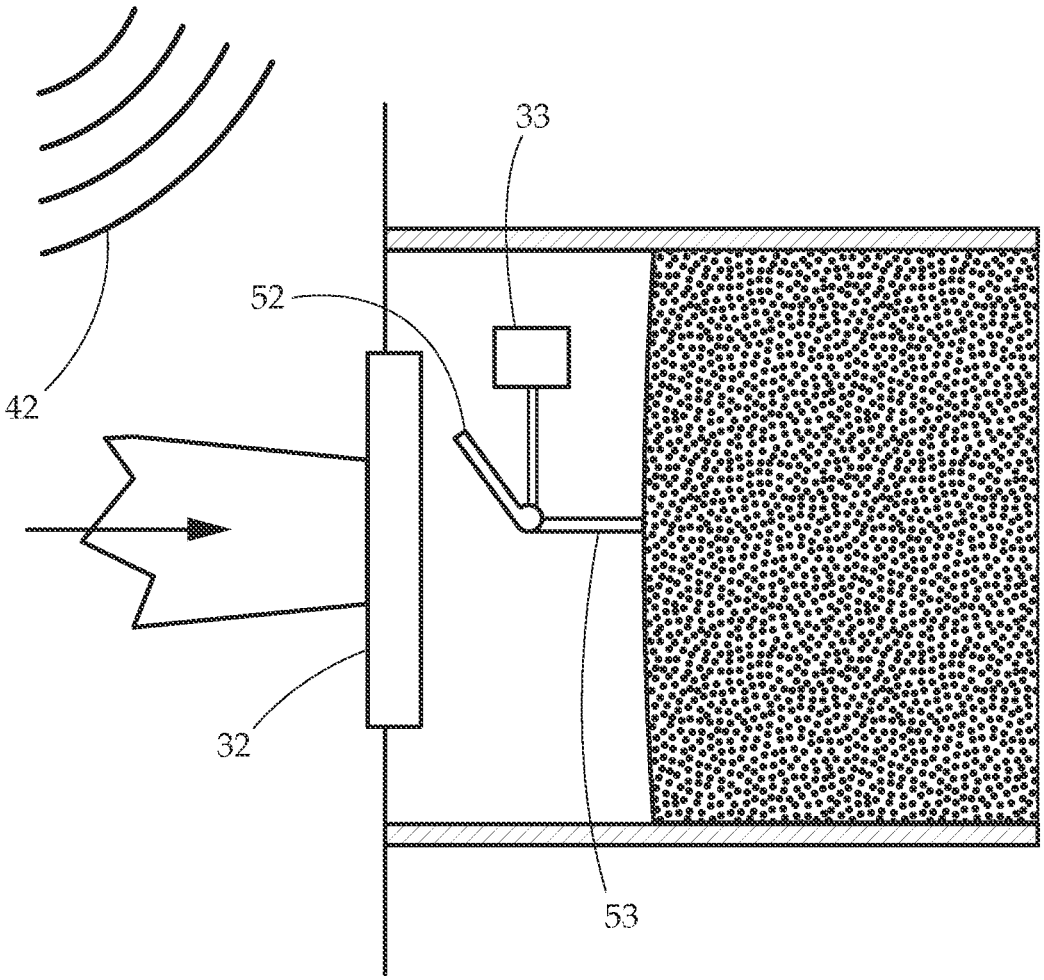
FIG. 5B provides a side cutaway view of yet another embodiment of the present disclosure.

FIGS. 5A and 5B show an embodiment of the primer cap having a switch. The switch 53, is movable between a closed position 51 and open position 52. In the closed position 51, which has the switch at rest when not exposed to the signal 42, the switch 53 provides a physical bridge between firing pin, rear wall 11 and/or striking area 32 and priming compound 12 as seen in FIG. 5A. The switch 53 spans cavity 35.

As seen in FIG. 5B, the signal receiver 33 is receiving signal 42. This causes the signal receiver 33 to send a signal to move the switch to the open position 52. Here, the firing pin strikes the striking area 32 but force is not transferred to the priming compound 12 because of the break caused by the switch 53. The switch may be controllable in any manner. In one embodiment, a radio frequency activate polymer may be used as either or both a signal receiver 33 or a switch actuator which deforms or contracts in the presence of the signal 42. This deformation draws the switch into the open mode 52. As noted above, there are a number of variations of systems which may actuate the switch once the predetermined signal 42 is received.

Figure 6:
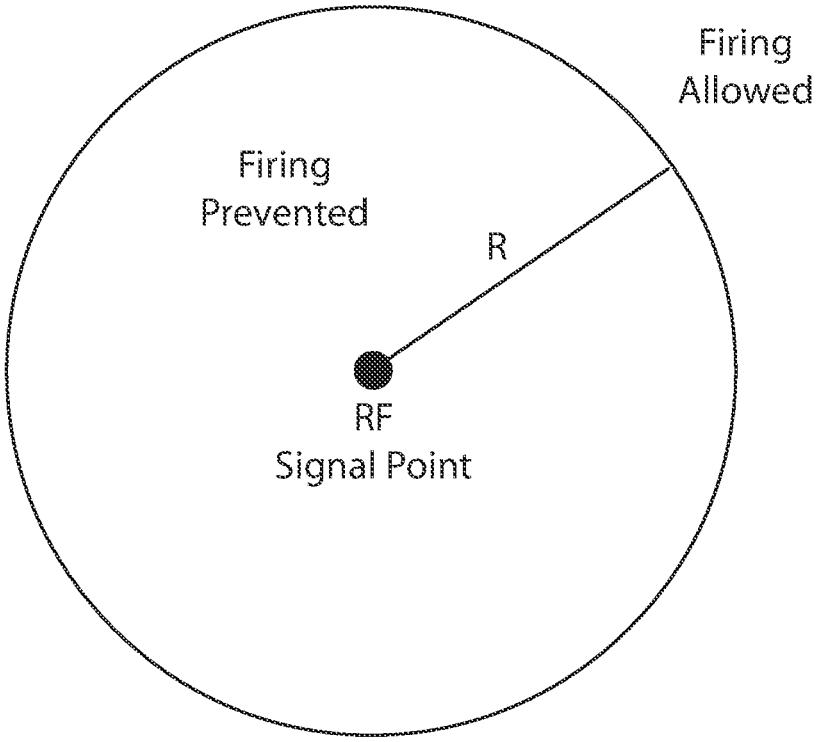
FIG. 6 provides a view of an embodiment of operation of the present disclosure.

FIG. 6 provides a view of an embodiment of a firearms control system which generates a radio-frequency signal which prevents firing of a firearm within the radius of the signal. A central RF signal point is shown to represent an emitter which emits, in this embodiment, a radio-frequency signal which is selected to deactivate the ammunition contemplated herein, either by deactivating a primer cap of the firearm cartridge, or other mechanism preventing ignition of the propellant of the cartridge. The RF signal emits in an approximately circular area of radius R, which varies in different embodiments depending on obstacles and materials in the area of signal emission. Also depending on obstacles and surrounding materials, in most cases the emission area is not a perfect circle. In large complexes such as schools, shopping malls, and other areas where firearm ammunition control is needed, there may be multiple signal emitters which overlap and ensure that there are no zones or sections in which the signal is not present. A computerized device having an antenna or other receiver may be programmed to scan for the specific frequency and/or signal pattern which is known to be operable to deactivate the firearm cartridge. The computerized device may provide a notification to a user when the predetermined signal is present and/or not present. For example, a computerized display may show an indication that the signal is present (such as a green color) and also an indication if the signal is not present (such as a red color).

In one embodiment, a facility having restricted firearm usage is contemplated. The facility defines a facility area or "zone." The facility has one or more signal transmitters which are configured to emit a signal covering at least part of the facility area and in many embodiments, the signal transmitter(s) are configured to emit a signal covering the entire area or zone of the facility. The signal transmitters are configured to emit a signal which is operable to deactivate a firearm cartridge of this disclosure, preventing its firing. Exemplary firearm cartridges which can be deactivated are disclosed in the above aspects and elsewhere throughout this disclosure. In a further embodiment, the facility may have a quantity of ammunition therein, but this ammunition is not usable due to the broadcasting of the signal. As noted above, the signal may be on the electromagnetic spectrum, including radio frequency, may be an acoustic signal, or any other signal which does not substantially interfere with humans.

Figure 7:
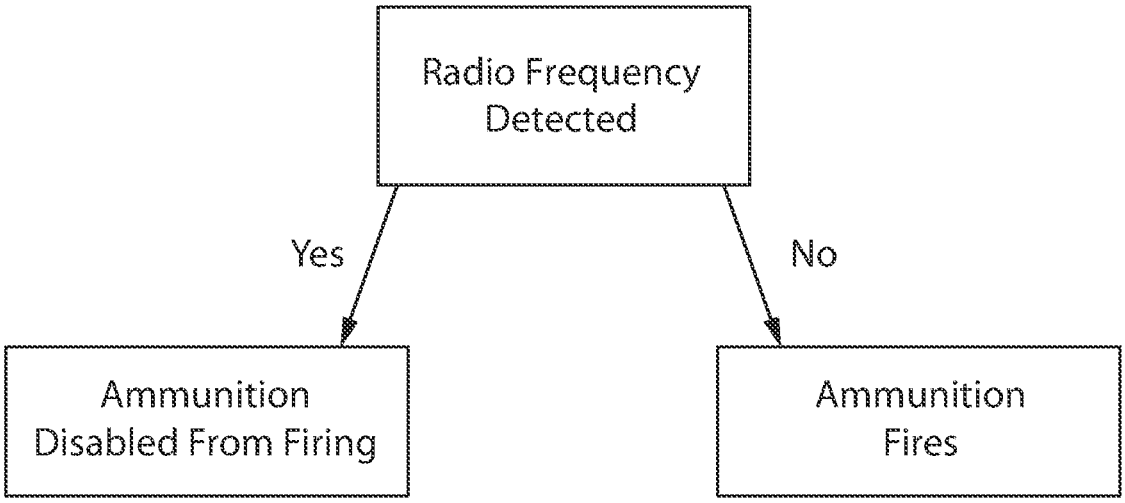
FIG. 7 provides a flow chart depicting an operational function of the present disclosure.

FIG. 7 provides a flow chart of an embodiment of the present disclosure wherein the firearm cartridge ammunition is disabled from firing based on the presence of a radio frequency. In this embodiment, if the radio frequency is detected by the receiver in the firearms cartridge, the ammunition is disabled from firing. If there is no signal detected, the ammunition can be fired like a traditional firearms cartridge.

While several variations of the present disclosure have been illustrated by way of example in preferred or particular embodiments, it is apparent that further embodiments could be developed within the spirit and scope of the present disclosure, or the inventive concept thereof. However, it is to be expressly understood that such modifications and adaptations are within the spirit and scope of the present disclosure, and are inclusive, but not limited to the following appended claims as set forth.

What is claimed is:

1. A firing primer for use in a firearm cartridge comprising:

a body having a rear wall and a quantity of priming compound within the body;

a signal receiver within the body adjacent to the rear wall, the signal receiver operable to allow ignition of the quantity of priming compound when not in the presence of a predetermined signal, and operable to prevent ignition of the quantity of priming compound when in the presence of the predetermined signal;

wherein the signal receiver is positioned on a microchip which is a radio-frequency powered microchip;

wherein the signal receiver is in communication with a switch; and wherein the switch is operable to bridge the rear wall of the body to the priming compound when not in the presence of the predetermined signal, and wherein the switch opens to create a physical separation between the rear wall of the body and the priming compound.

2. The firing primer of claim 1 positioned in a firearm cartridge.

3. The firing primer of claim 1 wherein the signal receiver is operable to receive an electromagnetic signal.

4. The firing primer of claim 1 wherein the signal receiver is operable to receive a sound signal.

5. The firing primer of claim 1 wherein the signal receiver comprising a radio-frequency activated polymer, the radio-frequency activated polymer operable to soften or change shape when in the presence of the predetermined signal, such that an impact on the rear wall of the body does not transfer a force to the priming compound sufficient to ignite the priming compound.

6. The firing primer of claim 1 wherein the signal receiver is in communication with a polymer, the polymer operable to soften or change shape under application of a current through the polymer, the signal receiver programmed to apply a current to the polymer, causing the polymer to soften or change shape when in the presence of the predetermined signal, such that an impact on the rear wall of the body does not transfer a force to the priming compound sufficient to ignite the priming compound.

7. The firing primer of claim 1 wherein the signal receiver is in communication with an inner wall, the signal receiver operable to cause a movement of the inner wall which spaces the inner wall, adjacent to the primer material, away from the rear wall.

8. A firearm cartridge comprising:

a cartridge case;

a quantity of gunpowder within the cartridge case;

a bullet at a proximal end of the cartridge case; and a primer, the primer comprising:

a body having a rear wall and a quantity of priming compound within the body;

a signal receiver within the cartridge case, the signal receiver operable to allow ignition of both the quantity of gunpowder and quantity of priming compound when not in the presence of a predetermined signal, and operable to prevent ignition of at least one of the quantity of gunpowder and the quantity of priming compound when in the presence of the predetermined signal;

wherein the signal receiver is positioned on a microchip which is a radio-frequency powered microchip;

wherein the signal receiver is in communication with a switch; and wherein the switch is operable to bridge the rear wall of the body to the priming compound when not in the presence of the predetermined signal, and wherein the switch opens to create a physical separation between the rear wall of the body and the priming compound.

9. The firearm cartridge of claim 8 wherein the switch is positioned between the primer and the quantity of gunpowder, the switch is operable to allow communication between an exhaust of the primer and the quantity of gunpowder when not in the presence of the predetermined signal, and wherein the switch creates a physical separation between the exhaust of the primer and the quantity of gunpowder based on the signal received by the signal receiver.

10. The firing primer of claim 8 wherein the signal receiver is operable to receive an electromagnetic signal.

11. The firing primer of claim 8 wherein the signal receiver is operable to receive a sound signal.

12. A facility having restricted firearm usage comprising:

a facility area;

a signal transmitter configured to emit a signal covering at least part of the facility area, the signal selected to be a predetermined signal operable to deactivate a cartridge of a firearm having a signal receiver operable to receive the predetermined signal, the cartridge of the firearm operable to fire when not in the presence of the predetermined signal;

a plurality of firearm cartridges, each of the plurality of firearm cartridges comprising:

a cartridge case;

a quantity of gunpowder within the cartridge case;

a bullet at a proximal end of the cartridge case; and a primer, the primer comprising:

a body having a rear wall and a quantity of priming compound within the body;

a signal receiver within the cartridge case, the signal receiver operable to allow ignition of both the quantity of gunpowder and quantity of priming compound when not in the presence of a predetermined signal, and operable to prevent ignition of at least one of the quantity of gunpowder and the quantity of priming compound when in the presence of the predetermined signal;

wherein the signal receiver is positioned on a microchip which is a radio-frequency powered microchip;

wherein the signal receiver is in communication with a switch;

wherein the switch is operable to bridge the rear wall of the body to the priming compound when not in the presence of the predetermined signal, and wherein the switch opens to create a physical separation between the rear wall of the body and the priming compound; and wherein the signal transmitter prevents firing of the plurality of firearm cartridges when the signal transmitter is broadcasting the predetermined signal, and allows firing of the plurality of firearm cartridges when the signal transmitter is not broadcasting the predetermined signal.

13. The firing primer of claim 1 wherein the signal receiver is operable to receive at least one of an electromagnetic signal and a sound signal.

* * * * *